US007510179B2

(12) United States Patent
Kim

(10) Patent No.: US 7,510,179 B2
(45) Date of Patent: Mar. 31, 2009

(54) PAPER FEEDING DEVICE AND IMAGE FORMING APPARATUS HAVING THE SAME

(75) Inventor: Ho-Dong Kim, Yongin-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 326 days.

(21) Appl. No.: 11/235,079

(22) Filed: Sep. 27, 2005

(65) Prior Publication Data

US 2006/0113721 A1 Jun. 1, 2006

(30) Foreign Application Priority Data

Dec. 1, 2004 (KR) ..... 10-2004-0099773

(51) Int. Cl.
*B65H 3/52* (2006.01)

(52) U.S. Cl. ..... 271/121; 271/109; 271/167

(58) Field of Classification Search ..... 271/167, 271/121, 109

See application file for complete search history.

(56) References Cited

U.S. PATENT DOCUMENTS

| | | | | |
|---|---|---|---|---|
| 4,207,998 | A * | 6/1980 | Schmid | 226/95 |
| 5,697,604 | A * | 12/1997 | Tanaka | 271/121 |
| 5,988,635 | A * | 11/1999 | Ohshima | 271/274 |
| 6,168,150 | B1 * | 1/2001 | Hori et al. | 271/121 |
| 6,367,795 | B1 * | 4/2002 | Matsuda et al. | 271/126 |
| 6,398,205 | B1 * | 6/2002 | Nakamura et al. | 271/18 |
| 6,824,132 | B2 * | 11/2004 | Asai et al. | 271/125 |
| 2002/0114642 | A1 * | 8/2002 | Rimai et al. | 399/167 |
| 2004/0108648 | A1 * | 6/2004 | Iida | 271/10.09 |
| 2004/0169326 | A1 * | 9/2004 | Nakano et al. | 271/121 |
| 2005/0067758 | A1 * | 3/2005 | Seki et al. | 271/121 |
| 2006/0022396 | A1 * | 2/2006 | Muramatsu | 271/121 |

FOREIGN PATENT DOCUMENTS

| | | |
|---|---|---|
| CN | 1316376 A | 10/2001 |
| JP | 03-211134 | 9/1991 |
| JP | 03-272940 | 12/1991 |
| JP | 08-108591 | 4/1996 |
| JP | 11-011717 | 1/1999 |
| JP | 2001-026327 | 1/2001 |
| JP | 2002-002985 | 1/2002 |
| KR | 2000-0065530 | 11/2000 |

OTHER PUBLICATIONS

Webster's New Basic Dictionary, © 2007 by Houghton Mifflin Company, p. 363.*

* cited by examiner

*Primary Examiner*—Patrick H Mackey
*Assistant Examiner*—Prasad V Gokhale
(74) *Attorney, Agent, or Firm*—Roylance, Abrams, Berdo & Goodman, LLP

(57) ABSTRACT

A paper feeding device and an image forming apparatus having the same. The paper feeding device includes a paper feeding cassette with a knock-up plate on which paper is stacked and an elastic member for elastically biasing the knock-up plate in an upward direction and a pickup roller for pressing and feeding paper stacked on the knock-up plate. The paper feeding device further includes a double feeding prevention member including a friction pad disposed below the pickup roller to prevent doubling feeding of paper fed by the pickup roller and a friction prevention portion disposed at a side on which a front end of the sheet of paper enters and reducing friction with entering paper.

12 Claims, 7 Drawing Sheets

PAPER FEEDING DEVICE AND IMAGE FORMING APPARATUS HAVING THE SAME

CROSS-REFERENCE TO RELATED PATENT APPLICATION

This application claims the benefit under 35 U.S.C §119(a) of Korean Patent Application No. 10-2004-0099773, filed on Dec. 1, 2004, in the Korean Intellectual Property Office, the entire disclosure of which is hereby incorporated by reference. This application is related to U.S. patent application Ser. No. 11/202,053, filed on Aug. 12, 2005.

BACKGROUND OF THE INVENTION

1. Field of the Invention

The present invention relates to an image forming apparatus. More particularly, the present invention relates to a paper feeding device which helps prevent double feeding of a sheet of paper and improves the paper feeding capability, and an image forming apparatus having the same.

2. Description of the Related Art

In general, a paper feeding device which picks up a sheet of paper stacked in a paper feeding cassette and feeds a picked-up sheet of paper to a printing unit installed inside of an image forming apparatus, is provided in an image forming apparatus such as a printer or a copying machine. An example of a conventional paper feeding device is shown in FIG. 1.

Referring to FIG. 1, the conventional paper feeding device includes a paper feeding cassette 71 on which a sheet of paper is stacked, a pickup roller 72 which picks up the sheet of paper from the paper feeding cassette 71, and a double feeding prevention member 73 which prevents double feeding of a sheet of paper.

The paper feeding cassette 71 includes a knock-up plate 71*a* on which a sheet of paper is stacked, and an elastic member (not shown), which elastically biases the knock-up plate 71*a* in an upward direction. The sheets of paper stacked on the knock-up plate 71*a* are fed by the pickup roller 72 one by one. A friction member 10 is disposed on an upper surface of the knock-up plate 71*a* which faces the pickup roller 72, so as to prevent double feeding of a sheet of paper. The friction member 10 provides a surface that creates greater frictional force than the frictional force between a sheet of paper and the rear surface of a last sheet of paper, thereby preventing double feeding of a sheet of paper.

The double feeding prevention member 73 includes a friction pad 4, which is disposed below the pickup roller 72, and prevents double feeding of a sheet of paper fed by the pickup roller 72. The friction pad 4 is attached to one side of the double feeding prevention member 73. The friction pad 4 provides a friction resistance to the rear surface of the sheet of paper fed by the pickup roller 72. In other words, even though a plurality of sheets of paper are fed by the pickup roller 72, progression of other sheets of paper is suppressed, and only the sheet of paper stacked on the knock-up plate 71*a* is fed.

An entrance portion 70 which is positioned between the pickup roller 72 and the friction pad 4 to prevent double feeding of sheets of paper, is formed with an opening size of 1-1.5 mm. A curl is produced on a front end of the sheet of paper fed by the pickup roller 72 from the entrance portion 70. When the size of the entrance portion 70 is large, the front end of the sheet of paper on which the curl is produced easily enters into the entrance portion 70, and the frequency of double feeding of a sheet of paper increases. Conversely, when the size of the entrance portion 70 is small, the frequency of double feeding of a sheet of paper decreases but the frequency of paper jams caused when the front end of the sheet of paper becomes jammed on the double feeding prevention member 73 increases due to the increased friction between the fed sheet of paper and the double feeding prevention member 73. As a result, paper feeding performance is degraded.

As described above, in the prior art, when the dimensions of the entrance portion 70 are minimized, the frequency of double feeding of a sheet of paper decreases, but the frequency in which the sheet of paper is jammed on the double feeding prevention member 73 increases according to the shape of the curve of the front end of the sheet of paper. In addition, when the dimensions of the entrance portion 70 are minimized, the friction between the lower side of the fed sheet of paper and the double feeding prevention member 73 increases, which reduces the paper feeding force. But when the paper feeding force of the sheet of paper generated by the pickup roller 72 increases, the surface of the pickup roller 72 wears more quickly than normal.

SUMMARY OF THE INVENTION

The present invention provides a paper feeding device having an improved structure in which the opening size of an entrance portion is minimized and paper jams or the lowering of the paper feeding force is prevented, and an image forming apparatus having the same.

According to an aspect of the present invention, there is provided a paper feeding device for an image forming apparatus, the paper feeding device comprising a paper feeding cassette comprising a knock-up plate on which paper is stacked and an elastic member for elastically biasing the knock-up plate in an upward direction; a pickup roller for pressing and feeding the sheet of paper stacked on the knock-up plate; and a double feeding prevention member comprising a friction pad disposed below the pickup roller for preventing doubling feeding of paper fed by the pickup roller and a friction prevention portion disposed on a side at which a front end of paper enters an opening formed between the pickup roller and the friction pad and which reduces the friction with entering paper. The friction prevention portion may comprise a roller.

A hole may be formed on a surface of the pickup roller that contacts the paper, the inner diameter at the hole opening preferably increases when pressed by a sheet of paper. The hole may extend in a rotational center of the pickup roller. The surface of the pickup roller that contacts the paper may be formed of a material having a Poisson's ratio that ranges from about 0.1 to about 0.49. The surface of the pickup roller that contacts paper is preferably formed of ethylene propylene diene monomer (EPDM). The friction prevention portion may include an inclined surface inclined toward the knock-up plate in a downward direction.

According to another aspect of the present invention, there is provided an image forming apparatus having a paper feeding device, wherein the paper feeding device comprises a paper feeding cassette comprising a knock-up plate on which paper is stacked and an elastic member for elastically biasing the knock-up plate in an upward direction; a pickup roller for pressing and feeding paper stacked on the knock-up plate; and a double feeding prevention member comprising a friction pad disposed below the pickup roller to prevent doubling feeding of paper fed by the pickup roller and a friction prevention portion disposed at a side, which a front end of the sheet of paper enters, for reducing friction with entering paper. The friction prevention portion may include a roller.

A hole may be formed on a surface of the pickup roller that contacts paper, the inner diameter at the opening of the hole increases when pressed by a sheet of paper.

The friction prevention portion preferably comprises an inclined surface inclined toward the knock-up plate in a downward direction.

BRIEF DESCRIPTION OF THE DRAWINGS

The above and other features and advantages of the present invention will become more apparent by describing in detail exemplary embodiments thereof with reference to the attached drawings in which.

Throughout the drawings, it should be understood that like reference numbers refer to like features, structures and elements.

DETAILED DESCRIPTION OF EXEMPLARY EMBODIMENTS

Figure 1:
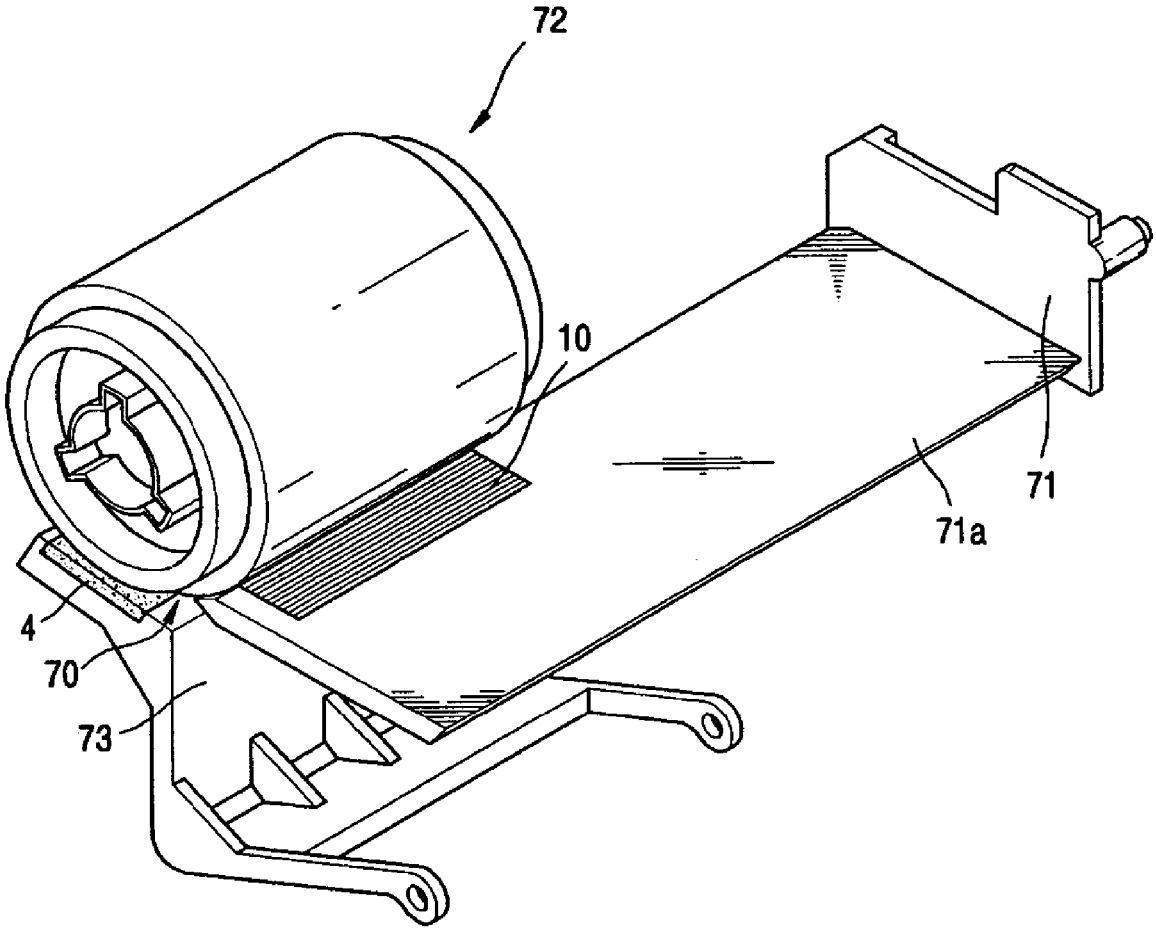
FIG. 1 (PRIOR ART)
FIG. 1 is a perspective view of a conventional paper feeding device.

A paper feeding device and an image forming apparatus having the same according to exemplary embodiments of the present invention will now be described with reference to the accompanying drawings. In the drawings, the thicknesses of lines or the sizes of components shown in the drawings are exaggerated for a better understanding of the embodiments of the present invention. In addition, an image forming apparatus having the paper feeding device according to an embodiment of the present invention will be described first and then the paper feeding device according to an embodiment of the present invention will be described in more detail. An image forming apparatus according to an embodiment of the present invention will be shown, but the present invention is not limited to an electrophotographic image forming apparatus.

Figure 2:
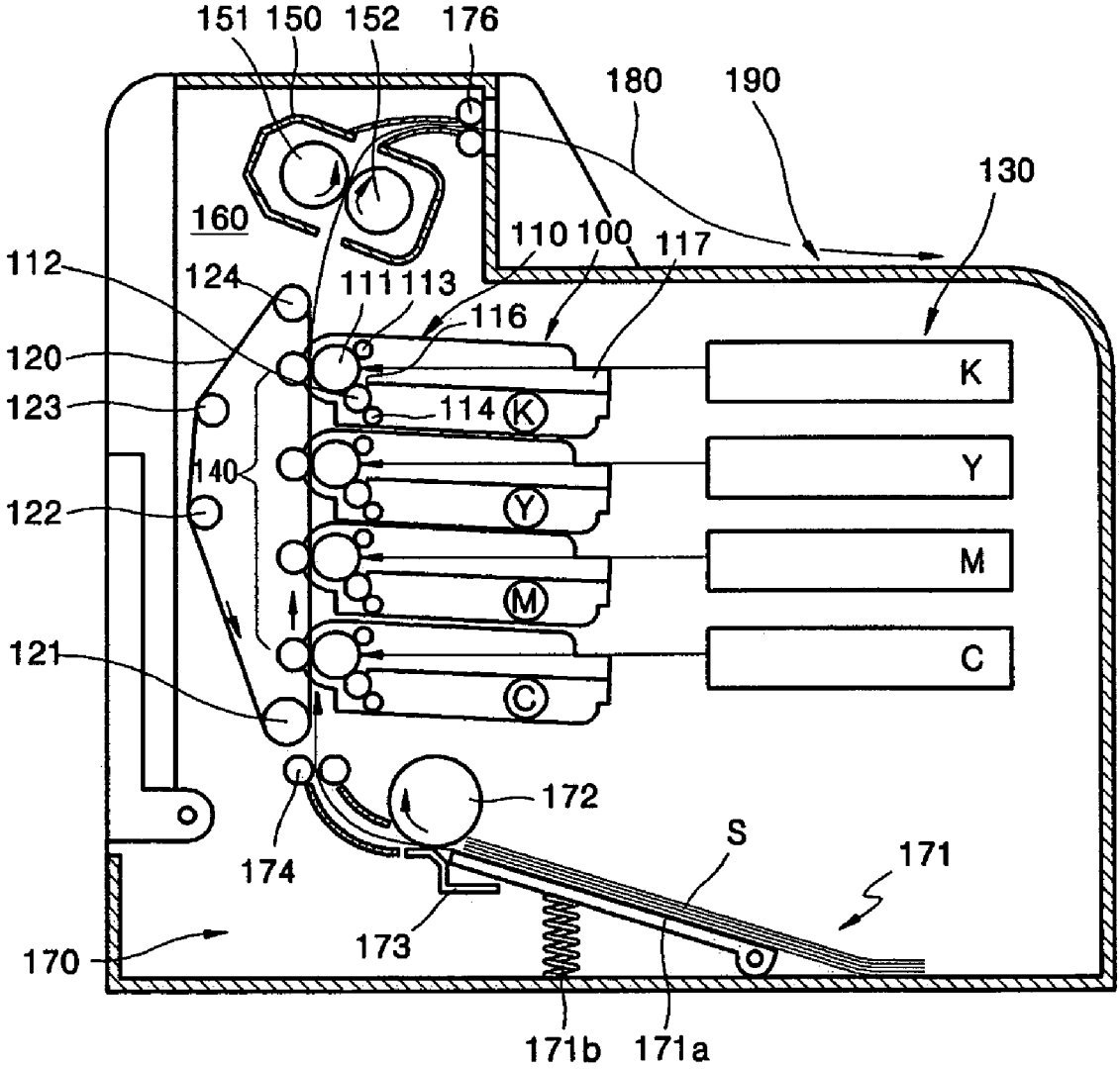
FIG. 2 is a schematic cross-sectional view of an image forming apparatus according to an embodiment of the present invention.

FIG. 2 is a schematic cross-sectional view of an image forming apparatus according to an embodiment of the present invention. Referring to FIG. 2, the image forming apparatus comprises a printing unit 160, which prints an image onto a sheet of paper S through an electrophotographic process, and a paper feeding device 170, which feeds the sheet of paper S to the printing unit 160.

The printing unit 160 preferably comprises four developing cartridges 110 in which toners having different colors, such as cyan (C), magenta (M), yellow (Y), and black (K), are held, a transfer belt 120, at least exposing units 130C, 130M, 130Y, and 130K, at least four transfer rollers 140, and a fusing unit 150.

The transfer belt 120 is supported by a plurality of support rollers 121, 122, 123, and 124 and travels in the direction shown by arrows. The transfer belt 120 in the present embodiment is preferably installed in a vertical direction. Each of the exposing units 130C, 130M, 130Y, and 130K radiates light corresponding to image information of colors such as cyan (C), magenta (M), yellow (Y), and black (K), onto a photosensitive drum 111 of each of the four developing cartridges 110 in response to a signal input from a computer.

Each of the developing cartridges 110 for each of the colors C, M, Y and K preferably comprises a photosensitive drum 111, a developing roller 112, a charging roller 113, a supplying roller 114, a toner layer regulating member 116, a cleaning member (not shown), and a storage portion (not shown). The photosensitive drum 111 is installed so that a portion of an outer circumference of the photosensitive drum 111 is exposed. The photosensitive drum 111 is rotated in a predetermined direction, and a photoconductive material layer is coated on the outer circumference of a metallic drum.

A charging bias voltage is applied to the charging roller 113 so as to charge the outer circumference of the photosensitive drum 111 to a uniform potential. A corona discharger (not shown) instead of the charging roller 113 may be used. The developing roller 112 supplies toner to the photosensitive drum 111 by adhering toners to the outer circumference of the developing roller 112. Solid powder toners are held in the developing roller 112, and the developing roller 112 develops a toner image by supplying the toners to an electrostatic latent image formed on the photosensitive drum 111. A development bias voltage for supplying the toners to the photosensitive drum 111 is applied to the developing roller 112.

The supplying roller 114 which adheres the toners to the developing roller 112 is installed outside the developing roller 112, and the toner layer regulating member 116 which regulates the amount of toner adhered to the developing roller 112 is installed in a frame 100.

Each of the developing cartridges 110 may further comprise an agitator (not shown) which transfers the toners held in each of the developing cartridges 110 toward the supplying roller 114 and/or the developing roller 112.

The developing cartridges 110 in the present embodiment comprise an opening 117 which forms a path so that light scanned by the exposing units 130C, 130M, 130Y, and 130K is radiated onto the photosensitive drum 111. An outer circumference surface exposed to the outer circumference of the photosensitive drum 111 faces the transfer belt 120.

The four transfer rollers 140 are disposed to face the photosensitive drum 111 of each of the developing cartridges 110 in the state where the transfer belt 120 is placed between each of the transfer rollers 140 and the photosensitive drum 111. In the present embodiment, a transfer bias voltage having a polarity opposite to that of the toner image is applied to the transfer roller 140 so that the toner image developed on the photosensitive drum 111 is transferred onto the sheet of paper S. The toner image is transferred onto the sheet of paper S by an electrostatic force that acts between the photosensitive drum 111 and the transfer roller 140.

The fusing unit 150 comprises a heating roller 151 and a pressing roller 152. The fusing unit 150 fuses the toner image on the paper by applying heat and pressure to the toner image that has been transferred onto the sheet of paper S. The heating roller 151 as a heat source for permanently fusing the toner image is installed to face the pressing roller 152 in an axial direction. The pressing roller 152 is installed to face the heating roller 151 and fuses the toner image on the paper by applying high pressure to the sheet of paper S.

A paper discharging roller 176 discharges the sheet of paper S, on which a fusing operation has been completed, to the exterior of the electrophotographic image forming apparatus. The sheet of paper S is discharged by the paper discharging roller 176 along a paper transfer path 180 from the printing unit 160, is stacked on a stacking portion 190.

The image forming apparatus further comprises a paper feeding device 170 which is disposed below the image forming apparatus and feeds the sheet of paper S to the printing unit 160. The paper feeding device 170 comprises a paper feeding cassette 171 on which the sheet of paper S is stacked, a pickup roller 172 which picks up the sheet of paper S from the paper feeding cassette 171, and a double feeding prevention member 173, which prevents double feeding of the sheet of paper S. A multi-purpose feeder (MPF), which can additionally feed the sheet of paper S, may be located at one side of the image forming apparatus.

The paper feeding cassette 171 as an example of a stacking unit on which the sheet of paper S is stacked, comprises a knock-up plate 171*a* on which the sheets of paper S are stacked, and an elastic member 171*b*, which elastically biases the knock-up plate 171*a* in an upward direction.

The sheets of paper S stacked on the knock-up plate 171*a* are transferred by the pickup roller 172 one by one, which will be described in more detail later. A friction member 210 may be disposed to face the pickup roller 172 on a top surface of the knock-up plate 171*a* to prevent double feeding in which a plurality of sheets of paper S stacked on the knock-up plate 171*a* are picked up at one time. The friction member 210 prevents double feeding by providing a greater frictional force than the frictional force between one sheet of paper S and the rear side of the last sheet of paper S.

The elastic member 171*b* elastically biases the sheet of paper S stacked on the knock-up plate 171*a* toward the pickup roller 172. In other words, the sheet of paper S stacked on the knock-up plate 171*a* contacts the pickup roller 172 due to the upward force provided by elastic member 171*b* and is transferred by the pickup roller 172 one by one.

Figure 3:
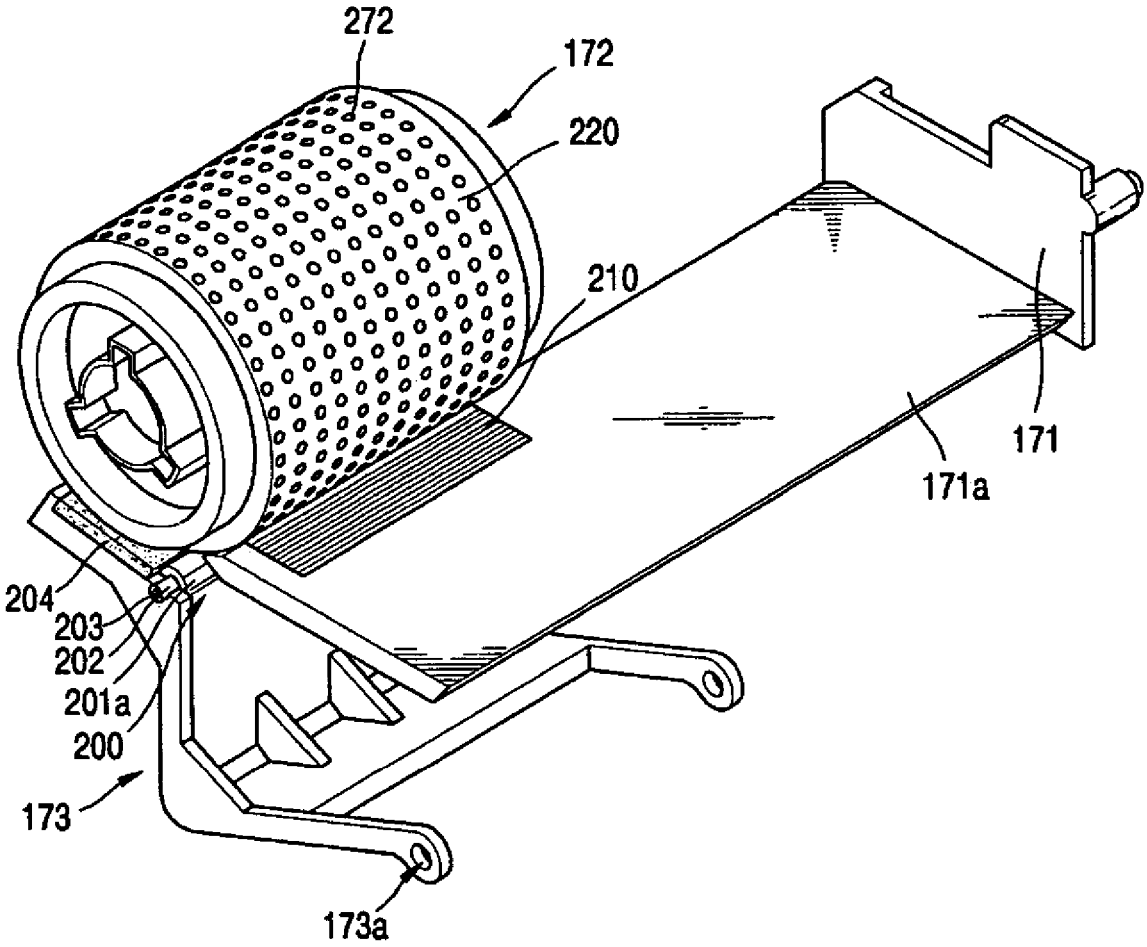
FIG. 3 is a perspective view of a paper feeding device according to another embodiment of the present invention.
Figure 4:
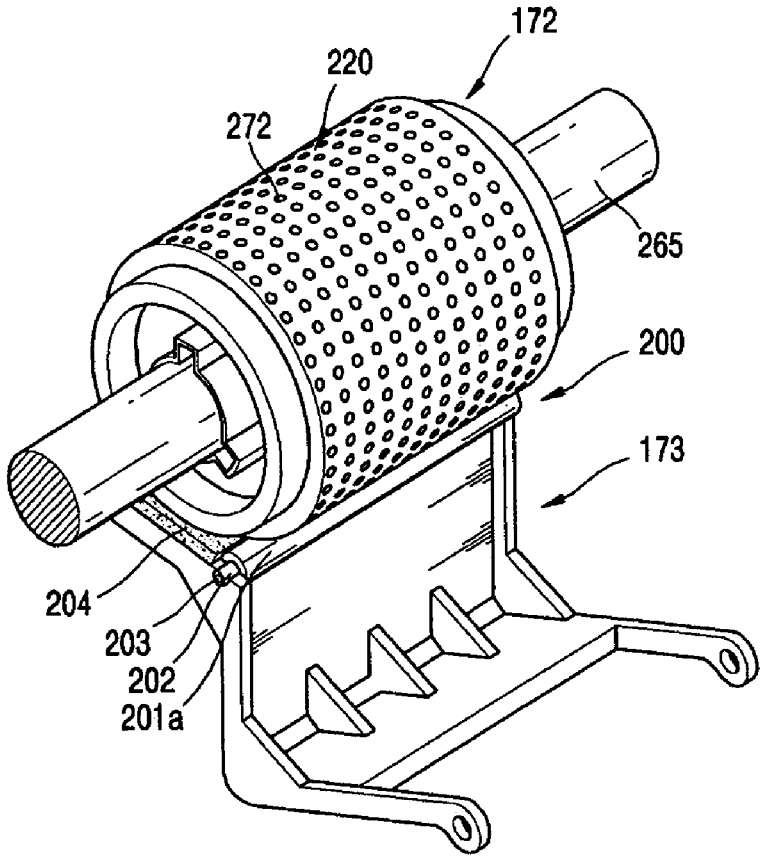
FIG. 4 is a perspective view of a pickup roller and a friction prevention member of the paper feeding device shown in FIG. 3.
Figure 5:
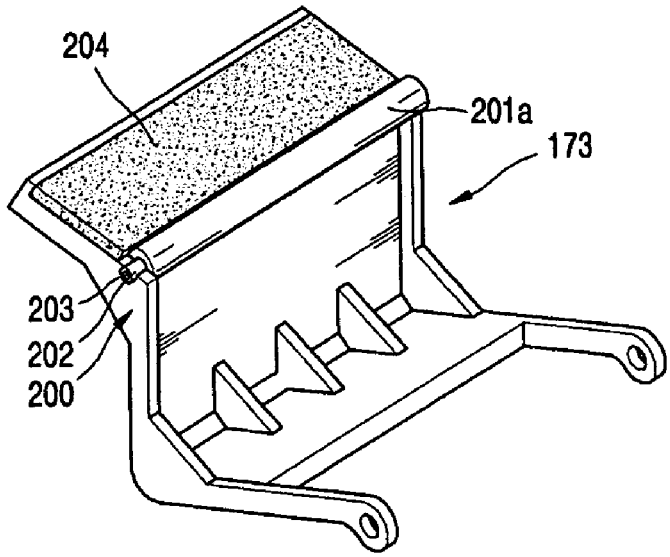
FIG. 5 is a perspective view of a friction prevention member of the paper feeding device shown in FIG. 3 according to another embodiment of the present invention.

FIG. 3 is a perspective view of a paper feeding device according to another embodiment of the present invention. FIG. 4 is a perspective view of a pickup roller and a friction prevention member of the paper feeding device shown in FIG. 3 according to an embodiment of the present invention. FIG. 5 is a perspective view of a friction prevention member of the paper feeding device shown in FIG. 3 according to another embodiment of the present invention.

Referring to FIGS. 3 through 5, the double feeding prevention member 173 comprises a friction pad 204 which is disposed below the pickup roller 172 and prevents double feeding of the sheet of paper S (not shown) transferred by the pickup roller 172, and a friction prevention portion 200, which is disposed on a side into which a front end of the sheet of paper S enters and reduces the friction with the entering sheet of paper S. In the present embodiment, the double feeding prevention member 173 is installed to be rotatable around point 173*a* and elastically biased by an elastic member (not shown) toward the pickup roller 172.

The friction pad 204 is attached to one side of the double feeding prevention member 173 and prevents double feeding of the sheet of paper S by the pickup roller 172. The friction pad 204 provides friction resistance to a rear side of the sheet of paper S fed by the pickup roller 172 to the printing unit 160 (not shown) so that only the sheet of paper S placed at the uppermost side is fed to the printing unit 160. In other words, even though a plurality of sheets of paper S may be fed by the pickup roller 172, any extra sheets of paper S are prevented from being fed by the friction pad 204 and only the sheet of paper S stacked above the knock-up plate 171*a* is fed to the printing unit 160. In order to perform this separation operation, the frictional force between the friction pad 204 and the sheet of paper S should be greater than a frictional force between the extra sheets of paper S. For example, the friction pad 204 may be manufactured of a material such as silicon-based elastomer and the like.

The smaller the opening between the pickup roller 172 and the friction pad 204, the more effective the separation operation of the sheet of paper S using the friction pad 204. In addition, in order to prevent double feeding of sheets of paper S, it is better to have a smaller opening at the entrance portion which the sheet of paper S enters between the pickup roller 172 and the friction pad 204. In other words, in order to prevent double feeding of the sheet of paper S, when the size of the opening of the entrance portion where the sheet of paper S enters, which is between the pickup roller 172 and the friction pad 204, is minimized, a plurality of sheets of paper S are prevented from entering the entrance portion.

However, when the interval between the pickup roller 172 and the friction pad 204 becomes narrow, the front end of the entering sheet of paper S can become caught on the double feeding prevention member 173 and does not enter the entrance portion. In other words, when the size of the opening of the entrance portion, which the sheet of paper S enters, is too narrow, the front end of the entering sheet of paper S is caught on the double feeding prevention member 173 and does not enter the entrance portion. Thus, when the opening between the pickup roller 172 and the friction pad 204 is minimized, friction is generated between the entering sheet of paper S and the double feeding prevention member 173. In order to minimize this friction, a friction prevention portion 200 is disposed in the double feeding prevention member 173.

The friction prevention portion 200 is disposed at a side of the paper feeding cassette 171, which the front end of the sheet of paper S fed by the pickup roller 172 enters, and prevents the sheet of paper S from being caught on the double feeding prevention member 173 so that the sheet of paper S enters between the pickup roller 172 and the friction pad 204. In addition, the friction prevention portion 200 reduces friction with the entering sheet of paper S. The friction prevention portion 200 may comprise a roller 201*a* (see FIG. 5) or an inclined surface 201*b* (see FIG. 6).

Referring to FIG. 5, the friction prevention portion 200 comprises a roller 201*a*. The roller 201*a* is installed to be rotatable around a shaft 202 in a groove 203 formed in the double feeding prevention member 173. In other words, the roller 201*a* is installed in the double feeding prevention member 173 to be freely rotated and prevents the front end of the sheet of paper S fed by the pickup roller 172 from being caught on the double feeding prevention member 173 or not entering the opening between the friction pad 204 and the pickup roller 172 (as shown in FIGS. 2-5). The roller 201*a* may be formed as one body with the shaft 202.

Figure 6:
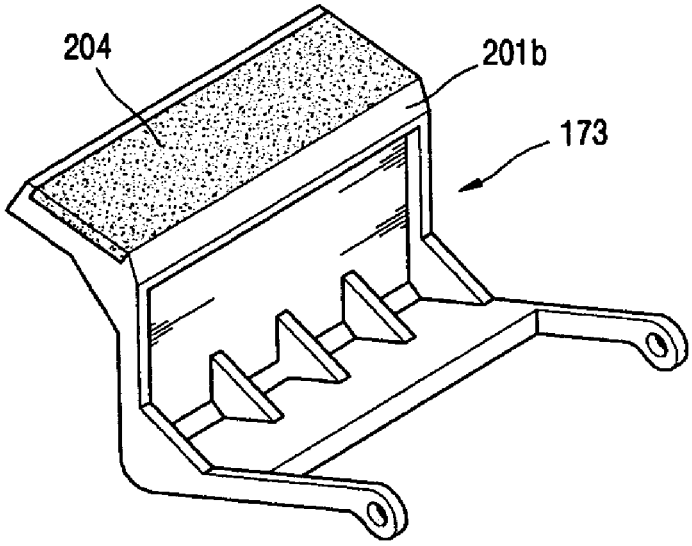
FIG. 6 is a perspective view of a friction prevention member of the paper feeding device shown in FIG. 3 according to another embodiment of the present invention.

FIG. 6 is a perspective view of a friction prevention member of the paper feeding device shown in FIG. 3 according to another embodiment of the present invention. Referring to FIG. 6, the friction prevention portion 200 may comprise the inclined surface 201*b*. The inclined surface 201*b* is inclined toward the knock-up plate 171*a* in a downward direction. The sheet of paper S fed by the pickup roller 172 is guided by the inclined surface 201*b* and fed to the friction pad 204. Thus, friction of the sheet of paper S that enters between the pickup roller 172 and the friction pad 204 with the double feeding prevention member 173 is minimized by the friction prevention portion 200 and thus paper feeding capability is improved.

Figure 7:
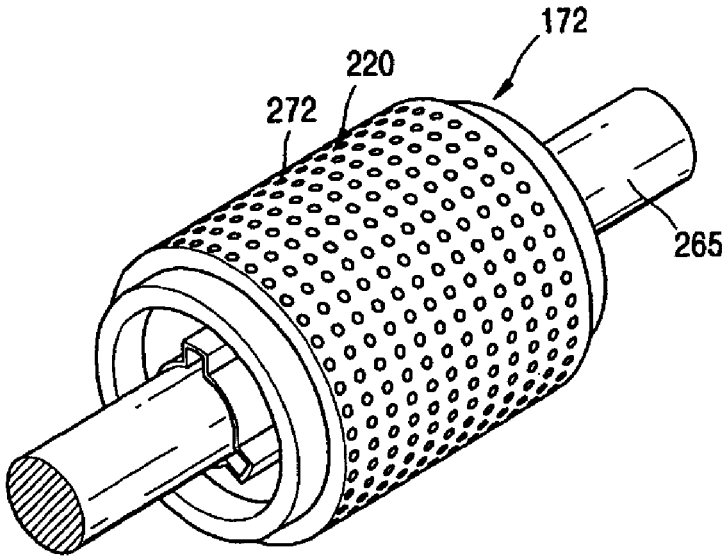
FIG. 7 is another perspective view of a pickup roller of the paper feeding device shown in FIG. 3 according to another embodiment of the present invention.
Figure 8:
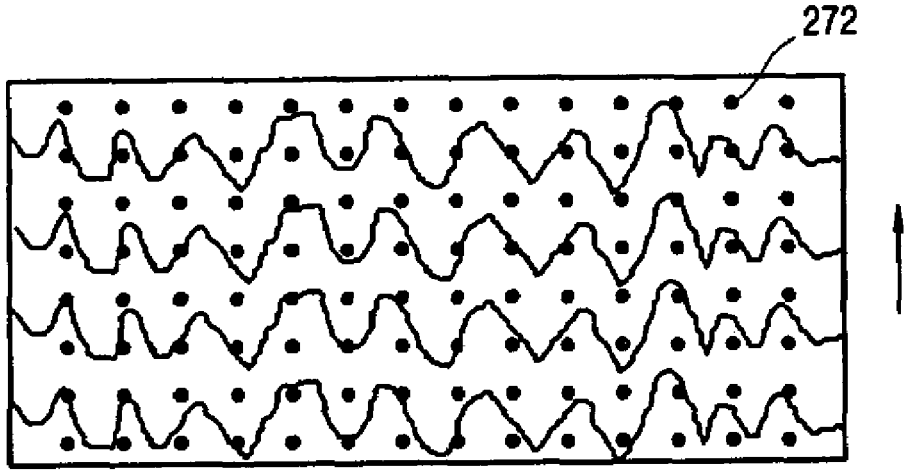
FIG. 8 is a plan view of a surface pattern of the pickup roller shown in FIG. 7 according to another embodiment of the present invention.
Figure 9:
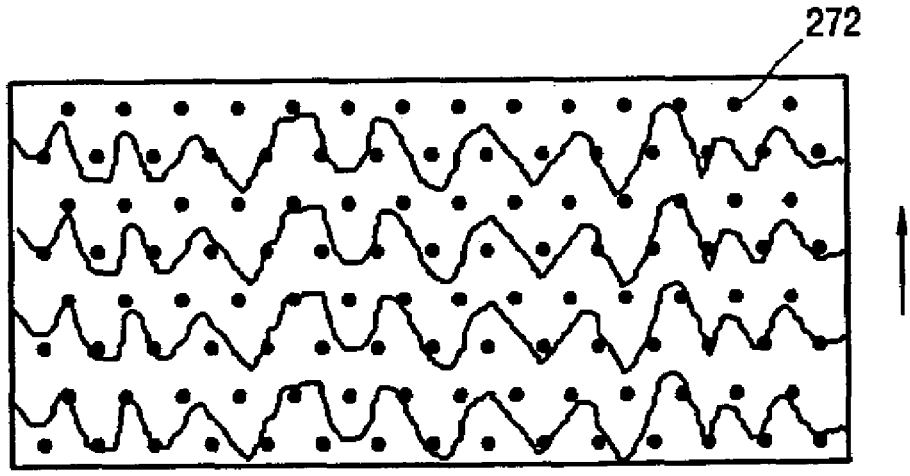
FIG. 9 is a plan view of a surface pattern of the pickup roller shown in FIG. 7 according to another embodiment of the present invention.
Figure 10:
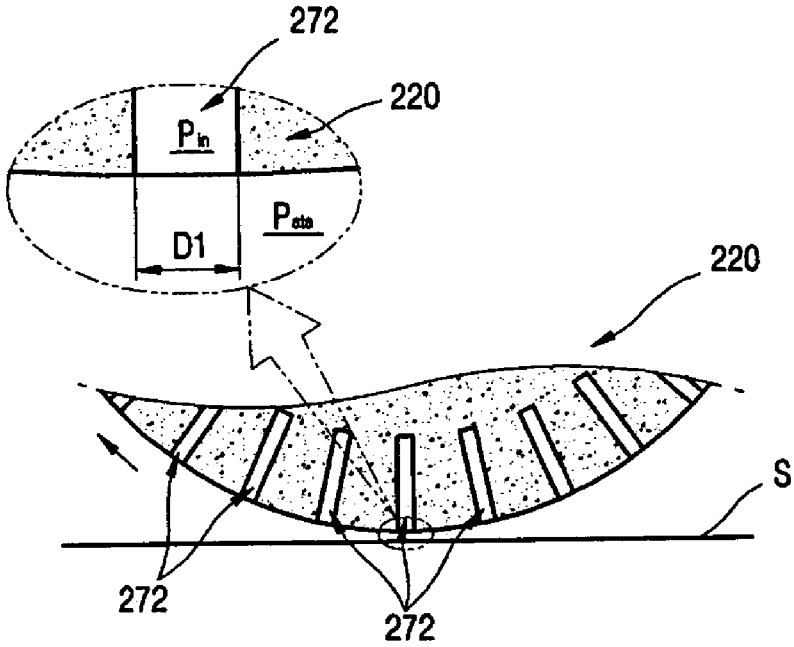
FIG. 10 is an enlarged cross-sectional view of a part of the pickup roller shown in FIG. 7 and illustrates the state before the pickup roller contacts a sheet of paper according to an embodiment of the present invention.
Figure 11:
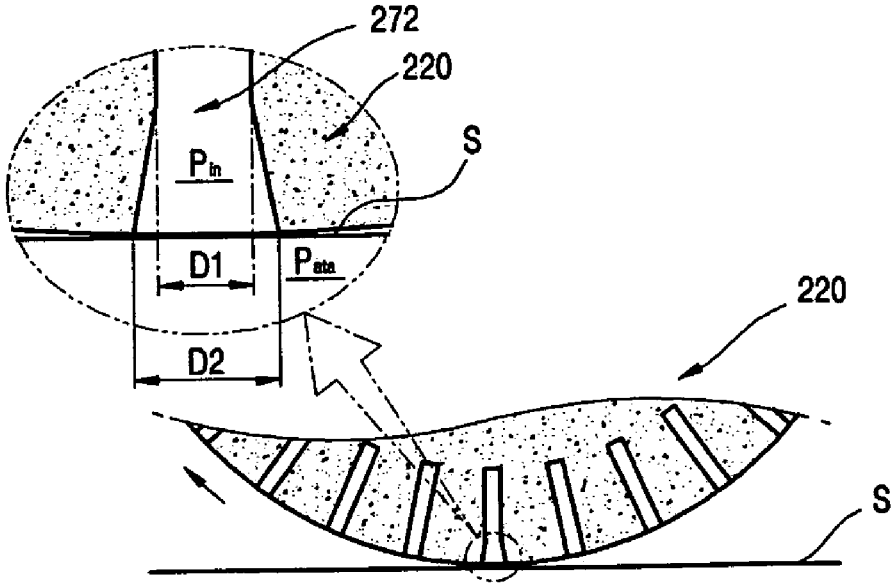
FIG. 11 is an enlarged cross-sectional view of a part of the pickup roller shown in FIG. 7 and illustrates the state where the pickup roller contacts the sheet of paper according to an embodiment of the present invention.

FIG. 7 is a perspective view of a pickup roller of the paper feeding device shown in FIG. 3. FIGS. 8 and 9 are plan views of a pickup roller surface pattern according to another embodiment of the present invention. FIGS. 10 and 11 are enlarged cross-sectional views of a part of the pickup roller shown in FIG. 7 and illustrate the state before the pickup roller contacts a sheet of paper and the state where the pickup roller contacts the sheet of paper S, respectively.

The pickup roller 172 is installed above the knock-up plate 171*a* and rotated in the state where a top side of a sheet of paper S is pressed, thereby feeding the sheet of paper S to the friction pad 204 via the friction prevention portion 200 from the knock-up plate 171*a*.

Referring to FIG. 7, a plurality of holes 272 are formed on a contact surface 220 of the pickup roller 172 that contacts the sheet of paper S, so as to improve the pickup performance. In addition, in order to improve the pickup performance, each of the plurality of holes 272 may be formed in various patterns. For example, the holes 272 may be formed in a regular pattern over the surface of the pickup roller 172, as shown in FIGS. 8 and 9. Specifically, in FIG. 8, the holes 272 are formed in a vertical direction parallel to the feeding direction of the sheet of paper S indicated by arrow, and in FIG. 9, the holes 272 are formed in a vertical direction perpendicular to the feeding direction of the sheet of paper S indicated by arrow. Unlike in FIGS. 8 and 9, the holes 272 may be formed in an irregular pattern over the surface of the pickup roller 172. In addition, the pickup roller 172 may have a wave surface pattern, so as to increase the frictional force on its surface.

Referring to FIG. 10, each of the holes 272 extends in a direction of a shaft 265 which is a rotational center of the pickup roller 172. In the state where the sheet of paper S stacked on the knock-up plate 171*a* does not contact the pickup roller 172, the pickup roller 172 and the holes 272 formed on the surface of the pickup roller 172 keep their original shapes, and the air pressure $P_{in}$ inside of the holes 272 and an external air pressure $P_{atm}$ are kept at the same level. When a printing operation starts, the knock-up plate 171*a* moves up and the sheet of paper S contacts the lower end of the pickup roller 172, as shown in FIG. 11, the lower end of the pickup roller 172 pressed by the sheet of paper S is deformed and the inner diameter of the holes 272 increases from D1 to D2. Since the above change occurs instantaneously, the change can be assumed as an adiabatic change procedure, and an increase in the inner diameter of the holes 272 causes an increase in the volume inside of the holes 272. Thus, the air pressure $P_{in}$ inside of the holes 272 will become less than the external air pressure $P_{atm}$, and due to the difference in pressure, a force in which the sheet of paper S will be pulled to the lower end of the pickup roller 172 will be generated.

The pickup roller 172 may be formed of a material having a Poisson's ratio that ranges from 0.1 to 0.49. Poisson's ratio is the ratio of horizontal deformation to vertical deformation created when a stress is applied to a material. If Poisson's ratio is smaller than 0.1, the pickup roller 172 becomes hard and a change of the inner diameter of the holes 272 is small. If Poisson's ratio is larger than 0.49, the pickup roller 172 becomes soft and may be deformed in a direction in which the inner diameter of the holes 272 is reduced.

The pickup roller 172 may be formed of EPDM, so as to increase the frictional force with the sheet of paper S. In other words, the surface of the pickup roller 172 that contacts the sheet of paper S may be formed of EPDM. Natural rubber (NR)-based, Nitrile Butadiene rubber (NBR)-based, urethane-based or silicon-based rubber instead of EPDM may be used to form the pickup roller 172.

A feed roller 174 feeds the sheet of paper S to be drawn out from the paper feeding cassette 171 by the pickup roller 172, to the printing unit 160. The sheet of paper S that has been fed in this manner passes through the printing unit 160. In this case, a toner image is transferred onto the sheet of paper S. The toner image transferred onto the sheet of paper S is fused on the sheet of paper S by the fusing unit 150 and discharged outside of the image forming apparatus by the paper discharging roller 176.

The operation of the paper feeding device and the image forming apparatus having the same according to an embodiment of the present invention will now be described.

Color image information is created by mixing information corresponding to colors such as cyan (C), magenta (M), yellow (Y), and black (K). In the present embodiment, a toner image of each color is transferred onto the sheet of paper S and fused thereon in the order of cyan (C), magenta (M), yellow (Y), and black (K), thereby forming a color image.

When the sheet of paper S is stacked on the paper feeding cassette 171 and the paper feeding cassette 171 is installed in the image forming apparatus, the following operation of forming an image is performed.

The photosensitive drum 11 of each of the developing cartridges 110 is charged by the charging bias voltage applied to the charging roller 113 to a uniform electric potential. Each of the four exposing units 130C, 130M, 130Y, and 130K radiates light corresponding to image information regarding colors such as yellow (Y) and magenta (M) of image onto the photosensitive drum 111 of each of the developing cartridges 110 via the opening 117. If light is scanned by each of the developing cartridges 110, only a scanned portion is selectively erased such that the electric potential is reduced, and an output pattern formed by this potential difference is an electrostatic latent image.

The toner is supplied to the developing roller 112 to which the development bias voltage is applied by the supplying roller 114. The toner adhered to the outer circumference of the developing roller 112 becomes thinner to a uniform thickness by the toner layer regulating unit 116. In this case, the toner is friction-charged by the developing roller 112 and the toner layer regulating unit 116. The toner adhered to the outer circumference of the developing roller 112 is adhered to the electrostatic latent image formed on the outer circumference of the photosensitive drum 111 so that toner images having colors such as cyan (C), magenta (M), yellow (Y), and black (K) are formed on the photosensitive drum 111 of each of the developing cartridges 110.

The sheet of paper S is drawn out from the paper feeding cassette 171 by the pickup roller 172, fed to the printing unit 160 via a predetermined paper feeding path, and is discharged to the exterior of the image forming apparatus by the paper discharging roller 176.

The pickup roller 172 is rotated in the state where the top side of the sheet of paper S stacked on the knock-up plate 171*a* is pressed, so that the sheet of paper S is fed to the friction pad 204 via the friction prevention portion 200 from the knock-up plate 171*a*. Any extra sheets of paper S fed to the friction pad 204 are prevented from being double fed by the friction pad 204, so that only the sheet of paper S placed at the uppermost side is fed to the feed roller 174. The sheet of paper S that has passed through the friction pad 204 is fed into the transfer belt 120 by the feed roller 174.

The sheet of paper S is attached to the surface of the transfer belt 120 by an electrostatic force and fed at the same velocity as the traveling linear velocity of the transfer belt 120. For example, the front end of the sheet of paper S reaches a transfer nip when the front end of the toner image of cyan (C) color formed on the outer circumference of the photosensitive drum 111 of the developing cartridge 110C reaches the transfer nip facing the transfer roller 140.

If a transfer bias voltage is applied to the transfer roller 140, the toner image formed on the photosensitive drum 111 is transferred onto the sheet of paper S. As the sheet of paper S is fed, toner images of colors such as magenta (M), yellow (Y), and black (K) formed on the photosensitive drums 111 of the developing cartridges 110 are superimposed on the sheet of paper S and transferred thereonto, and a color toner image is formed on the sheet of paper S.

The toner that remains on the outer circumference of the photosensitive drum 111 after the transfer operation is completed, is removed by a cleaning member (not shown). The fusing unit 150 fuses the toner image on the paper by applying heat and pressure to the toner image formed on the paper after the transfer operation is completed. The sheet of paper S is discharged out of the image forming apparatus by the paper discharging roller 176. The sheet of paper S discharged by the paper discharging roller 176 along the paper feeding path 180 is stacked on the stacking portion 190.

With the above structure, the distance between the pickup roller 172 and the double feeding prevention member 173 can be minimized, and a paper feeding performance of the sheet of paper S due to the pickup roller 172 can be improved.

As described above, in the paper feeding device and the image forming apparatus having the same according to an embodiment of the present invention, the interval of the entrance portion between the pickup roller and the double feeding prevention member is minimized such that a plurality of sheets of paper are prevented from entering the entrance portion. In addition, the friction prevention portion is disposed in the entrance portion of the sheet of paper such that the friction with the entering sheet of paper is minimized and the paper feeding performance is improved. Furthermore, since the pickup roller pulls the sheet of paper with a suction force caused by deformation of the holes, it assists in the feeding of the paper. Accordingly, the paper feeding performance is improved. Furthermore, the frictional force between the sheet of paper and the pickup roller is adjusted such that the frictional force between sheets of paper stacked on the knock-up plate in upward and downward directions is reduced and double feeding of the sheet of paper can be prevented. Furthermore, the frictional force between the sheet of paper and the pickup roller is adjusted such that wear on the pickup roller is reduced and the durability of the pickup roller is improved.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A paper feeding device for an image forming apparatus, the paper feeding device comprising:

a paper feeding cassette including a knock-up plate on which paper is stackable and an elastic member for elastically biasing the knock-up plate in an upward direction;

a pickup roller for pressing and feeding the sheet of paper stacked on the knock-up plate; and a double feeding prevention member for preventing double feeding of paper fed by the pickup roller, the double feeding prevention member comprises a friction pad disposed below the pickup roller and a friction prevention portion disposed on a side at which a front end of paper enters an opening between the pickup roller and the friction pad;

wherein the friction prevention portion comprises a roller.

2. The device of claim 1, wherein a hole, which is formed on a surface of the pickup roller that contacts the paper, and an inner diameter of the opening of the hole increases when contacted.

3. The device of claim 2, wherein the hole extends toward a rotational center of the pickup roller.

4. The device of claim 2, wherein a surface of the pickup roller that contacts paper is formed of a material having a Poisson's ratio ranging from about 0.1 to about 0.49.

5. The device of claim 2, wherein the surface of the pickup roller that contacts paper is formed of ethylene propylene diene monomer (EPDM).

6. A paper feeding device for an image forming apparatus, the paper feeding device comprising:

a paper feeding cassette including a knock-up plate on which paper is stackable and an elastic member for elastically biasing the knock-up plate in an upward direction;

a pickup roller for pressing and feeding the sheet of paper stacked on the knock-up plate; and a double feeding prevention member for preventing double feeding of paper fed by the pickup roller, the double feeding prevention member comprises a friction pad disposed below the pickup roller and a friction prevention portion disposed on a side at which a front end of paper enters an opening between the pickup roller and the friction pad;

wherein a hole having a single opening is formed on a surface of the pickup roller that contacts the paper, and an inner diameter of the opening of the hole increases when contacted to create a suction force.

7. The device of claim 6, wherein the hole extends towards a rotational center of the pickup roller.

8. The device of claim 6, wherein the surface of the pickup roller that contacts paper is formed of a material having a Poisson's ratio ranging from about 0.1 to about 0.49.

9. The device of claim 6, wherein the surface of the pickup roller that contacts paper is formed of ethylene propylene diene monomer (EPDM).

10. An image forming apparatus having a paper feeding device, wherein the paper feeding device comprises:

a paper feeding cassette comprising a knock-up plate on which paper is stackable and an elastic member for elastically biasing the knock-up plate in an upward direction;

a pickup roller for pressing and feeding paper stacked on the knock-up plate; and a double feeding prevention member including a friction pad disposed below the pickup roller to prevent double feeding of paper fed by the pickup roller and a friction prevention portion disposed on a side at which a front end of the sheet of paper enters an opening between the pickup roller and the friction pad;

wherein the friction prevention portion comprises a roller.

11. The apparatus of claim 10, wherein a hole is formed on a surface of the pickup roller that contacts the paper, and an inner diameter of the opening of the hole increases when contacted.

12. An image forming apparatus having a paper feeding device, wherein the paper feeding device comprises:

a paper feeding cassette comprising a knock-up plate on which paper is stackable and an elastic member for elastically biasing the knock-up plate in an upward direction;

a pickup roller for pressing and feeding paper stacked on the knock-up plate; and a double feeding prevention member including a friction pad disposed below the pickup roller to prevent double feeding of paper fed by the pickup roller and a friction prevention portion disposed on a side at which a front end of the sheet of paper enters an opening between the pickup roller and the friction pad;

wherein a hole having a single opening is formed on a surface of the pickup roller that contacts the paper, and an inner diameter of the opening of the hole increases when contacted to create a suction force.

* * * * *